US006060676A

United States Patent [19]

Pan

[11] Patent Number: 6,060,676

[45] Date of Patent: May 9, 2000

[54] KEYSWITCH ASSEMBLY

[75] Inventor: Hua-Tseng Pan, Taipei, Taiwan

[73] Assignee: Hon Hai Precision Ind. Co., Ltd., Taipei Hsien, Taiwan

[21] Appl. No.: 09/092,492

[22] Filed: Jun. 5, 1998

[30] Foreign Application Priority Data

Jun. 7, 1997 [TW] Taiwan ..... 86209581

[51] Int. Cl.[7] ..... H01H 13/70

[52] U.S. Cl. ..... 200/344; 200/341

[58] Field of Search ..... 200/341, 344, 200/345

[56] References Cited

U.S. PATENT DOCUMENTS 5,813,521 9/1998 Koike et al. ..... 200/344

5,829,579 11/1998 Tsai ..... 200/344

5,847,337 12/1998 Chen ..... 200/5 A 5,850,194 12/1998 Lin ..... 341/22

*Primary Examiner*—M. L. Gellner

*Assistant Examiner*—Nhung Nguyen

[57] ABSTRACT

A keyswitch assembly generally comprises a substrate having an opening defined therein. The substrate further forms two pair of supporting lugs adjacent to the opening. A keycap has two pair of mounting lugs that can be attached to the substrate by means of a pair of supporting linkages. One end of each supporting linkage is pivotally supported by the corresponding pair of supporting lugs of the substrate and the other end of each supporting linkage is movably supported by the corresponding pair of mounting lugs of the keycap, wherein said first and second pivoting buds are arranged at a first side defined by said centerline.

6 Claims, 4 Drawing Sheets

KEYSWITCH ASSEMBLY

FIELD OF THE INVENTION

The present invention relates to a keyswitch assembly, and more particularly to a keyswitch assembly for use with a keyboard and having a reduced height.

DESCRIPTION OF PRIOR ART

Almost every data processing system requires a data-inputting device, such as a keyboard or a keypad. Conventionally, the keyboard is separate from the housing of the computer, as in a desktop computer.

However, as portable and laptop computers become more and more popular, the overall dimension of such computers becomes increasingly more and more compact and the unoccupied space within a housing thereof decreases. Accordingly, a compact keyswitch is required to meet the trend toward miniaturization of the portable and laptop computer industry.

A wide range of keyswitches are available for use on keyboards of desktop computers, which cannot be used with laptop or notebook computers because the former is too large to fulfill compact design requirements. Keyswitches for use in notebook computers not only require a compact dimension, but must also provide a reliable and durable operation.

Taiwan Utility Patent Application No. 84-2-18262 (hereinafter referred to as '262) discloses a keyswitch having scissors-type supporting linkage. Each of the supporting arms is further provided with a sector-shaped linkage that is meshed with teeth located at a free end thereof. The keyswitch of the '262 patent achieves to its intended purpose, however, the overall height of the keyswitch is high enough to be disadvantageous to the compact design of the notebook computer. As shown in FIG. 1, a sectional sub-linkage 30 has a bulky size and occupies a considerable space. Furthermore, the keyswitch is enclosed in a large housing 31 which renders the overall size of the keyswitch unacceptable for a compact notebook computer. The supporting linkage 30 and the housing 31 are arranged above a substrate 32 which is normally a metal sheet having a plurality of openings defined therein. The height of the housing 31 will also increase the overall dimension of the keyswitch.

U.S. Pat. Nos. 5,657,860, 4,580,022 and 4,902,862 disclose different keyswitch having a reduced height, however, the manufacture and assembly process thereof is complicated and laborious. Hence, an improved keyswitch is required to overcome the disadvantages of the prior alt.

SUMMARY OF THE INVENTION

Accordingly, an objective of the present invention is to provide an improved keyswitch assembly having a supporting linkage which reduces the overall size of the keyswitch.

Another objective of the present invention is to provide an improved keyswitch assembly having a supporting linkage which is completely received within the keycap when the keycap is depressed thereby reducing the overall height of the keyswitch assembly.

In order to achieve the objective set forth, the keyswitch assembly generally comprises a substrate having an opening defined therein. The substrate forms two pair of supporting lugs adjacent to the opening. A keycap includes two pairs of mounting lugs that can be attached to the substrate by means of a pair of supporting linkages. One end of each supporting linkage is pivotally supported by a corresponding pair of supporting lugs of the substrate and the other end of each supporting linkage is movably supported by the corresponding pair of mounting lugs of the keycap, wherein first and second ends are arranged at a same side defined by a centerline on the keycap.

These and additional objects, features, and advantages of the present invention will become apparent after reading the following detailed description of the preferred embodiment of the invention taken in conjunction with the appended drawing.

DETAILED DESCRIPTION OF THE PREFERRED EMBODIMENT

Figure 1:
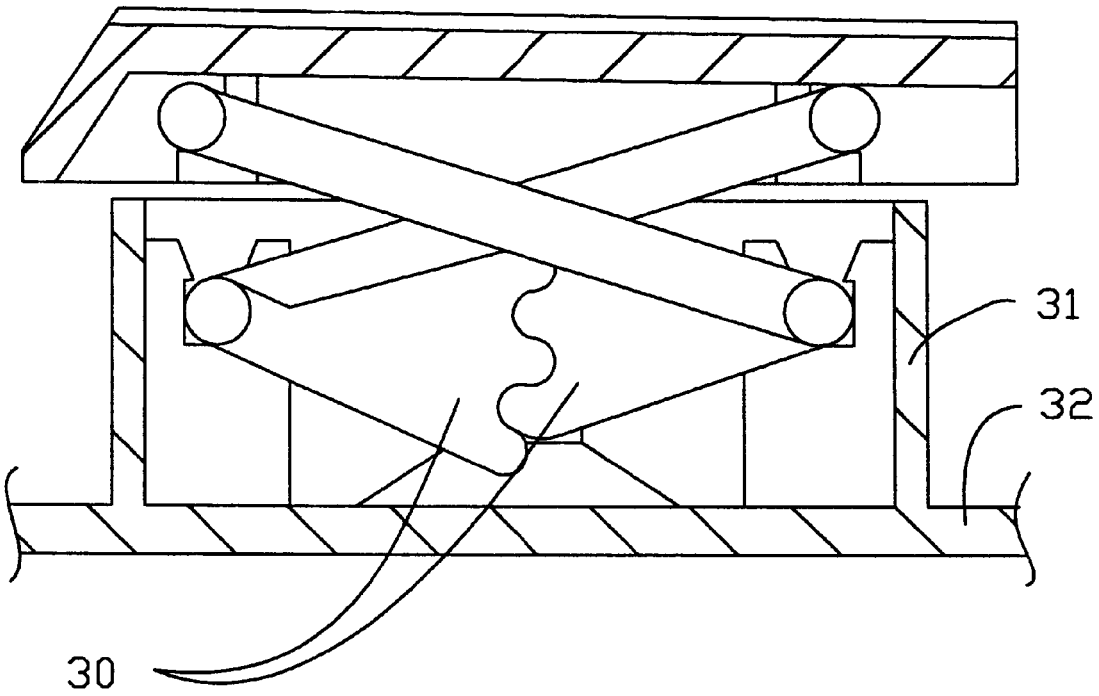
(PRIOR ART) FIG.1
FIG. 1 is a cross sectional view of a conventional keyswitch.
Figure 2:
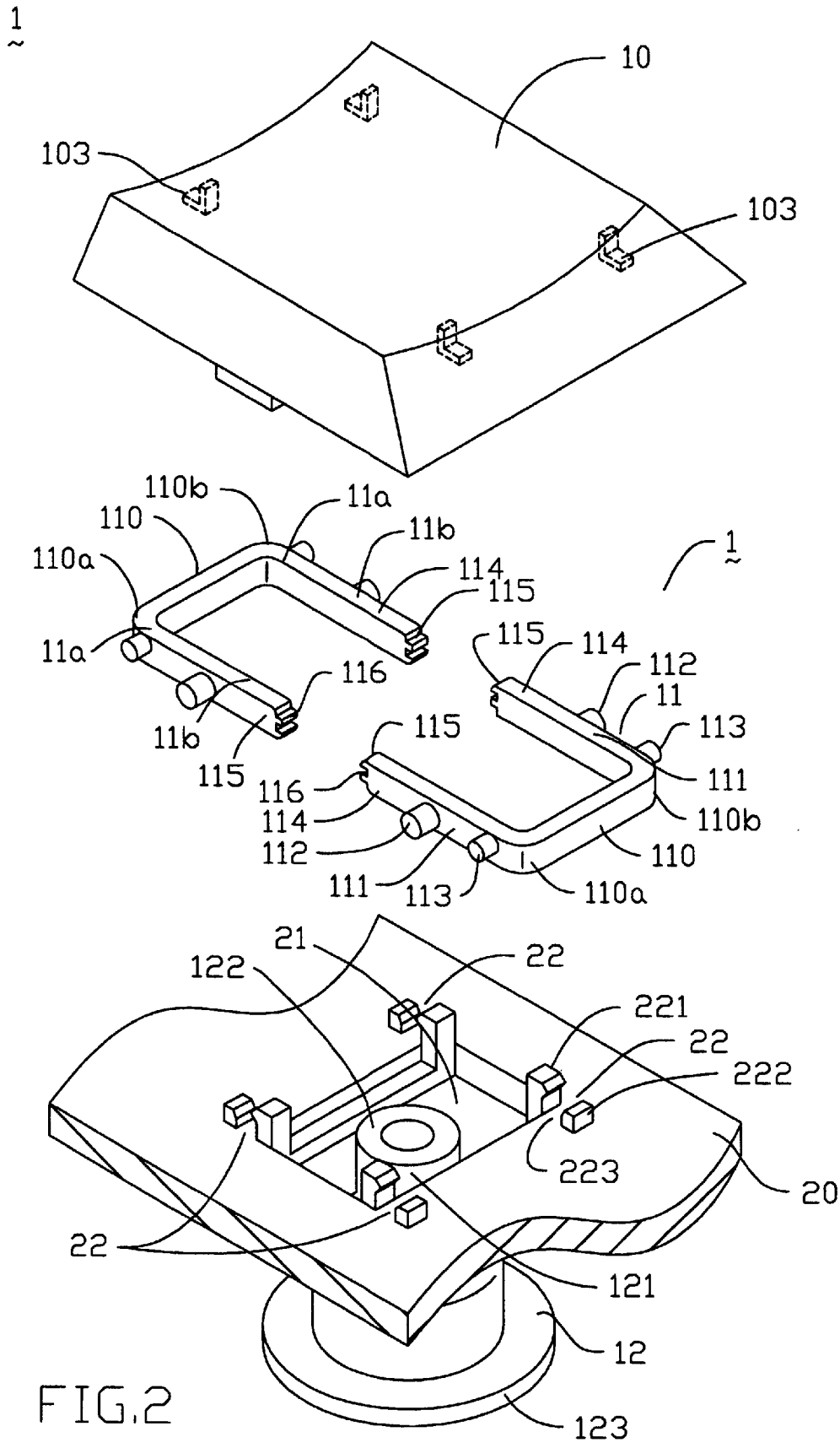
FIG. 2 is an exploded view of the keyswitch assembly according to the present invention.
Figure 3:
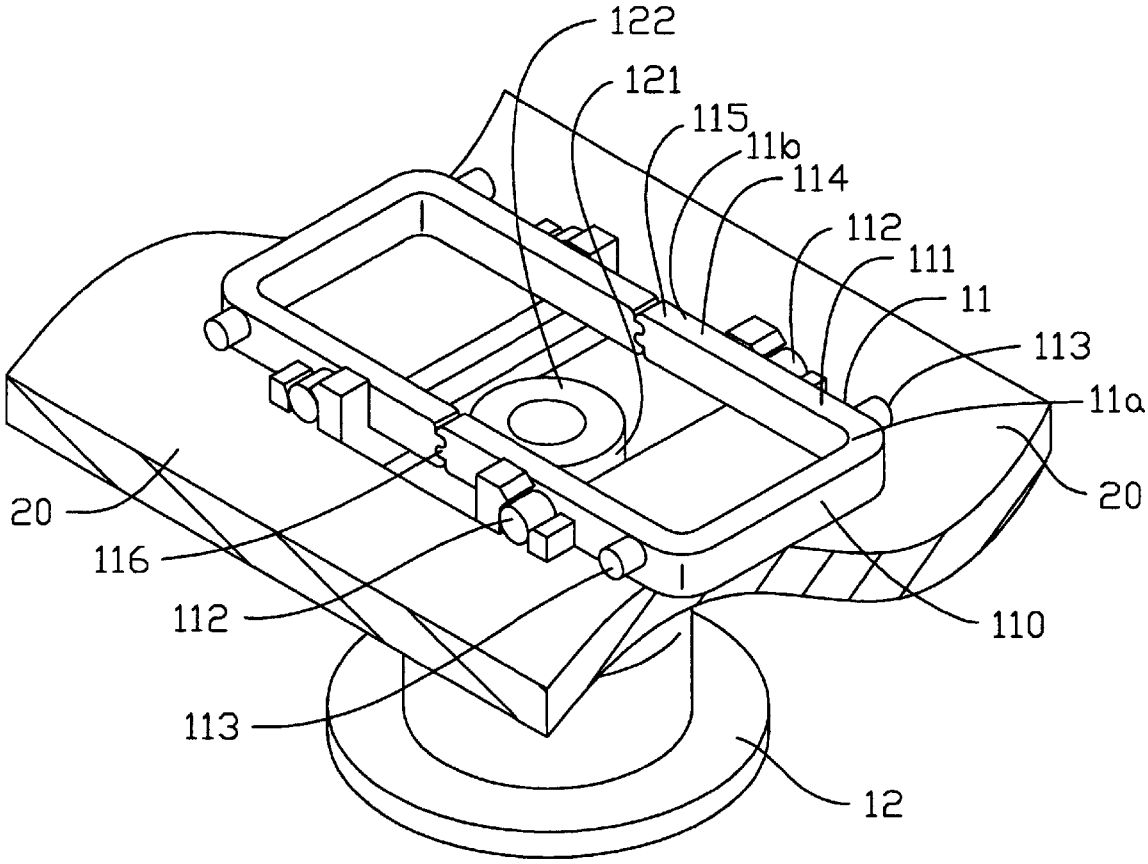
FIG. 3 is a perspective view of the keyswitch assembly with the keycap is removed.

Referring to FIG. 2, a keyswitch assembly 1 generally comprises a substrate 20 with an opening 21 defined therein. Two pairs of supporting lugs 22 are arranged adjacent to the opening 21 and each of the supporting lugs 22 includes a first clipping post 221 and a second clipping post 222. A receiving opening 223 is defined between the first and second clipping posts 221, 222. A resilient dome-shape actuator 12 has an upper part 121 projecting through the opening 21 of the substrate 20. A bottom end 123 of the actuator 12 is supported onto a membrane switch (not shown).

A supporting linkage 11 having a U-shaped includes a horizontal portion 110 and a vertical portion 111 extending from each lateral end 110*a* (110*b*) of the horizontal portion 110. Each vertical portion 111 forms a first pivoting bud 112 at a first end 11*a* and a second pivoting bud 113 at a second end 11*b*. The first pivoting bud 112 is pivotally received in the receiving opening 223 of the supporting lug 22.

Figure 4A:
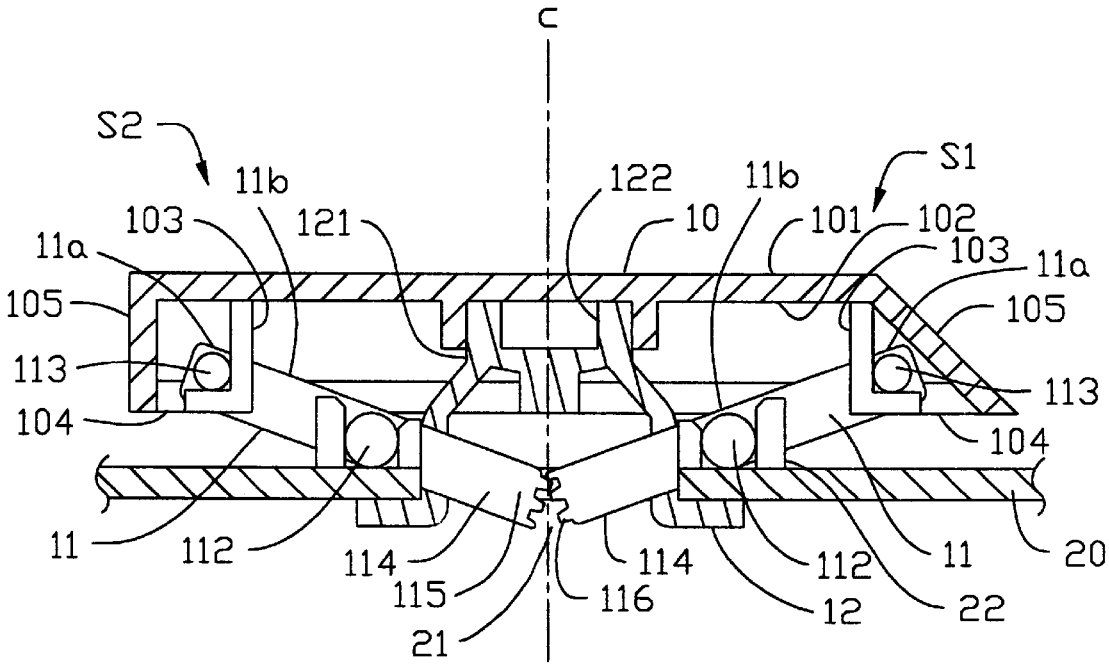
FIG. 4A is a schematic illustration of the keyswitch before the keycap is depressed.
Figure 4B:
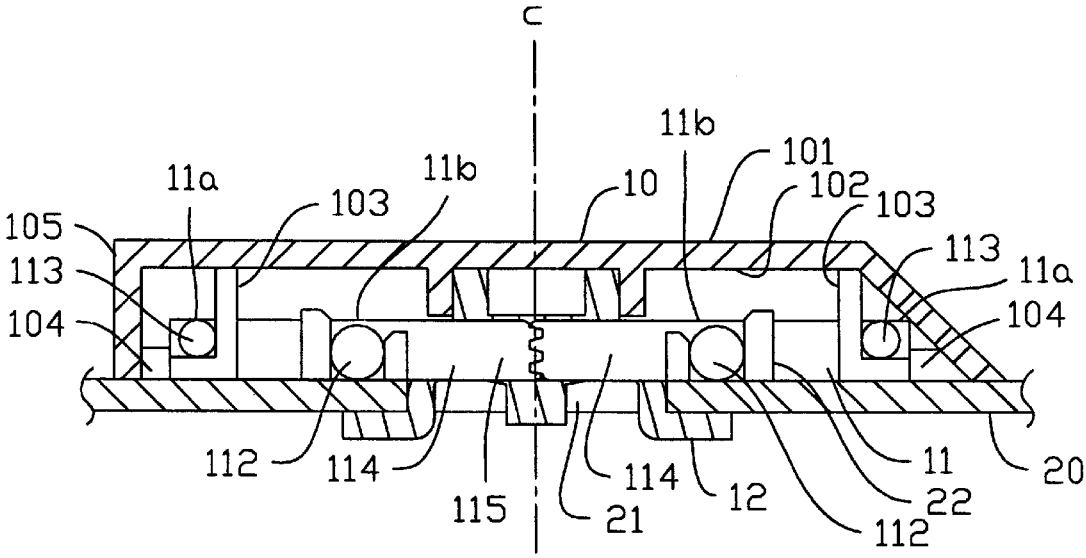
FIG. 4B is a schematic illustration of the keyswitch after the keycap is depressed.

A keycap 10 defines a depressing surface 101 and a centerline C defining first and second ends S1, S2 a mounting surface 102, see FIGS. 4A and 4B. The mounting surface 102 of the keycap 10 is provided with a plurality of mounting lugs 103 each having an L-shape configuration. An opening 104 is defined between each mounting lug 103 and a sidewall 105 of the keycap 10. As a result, the second pivoting bud 113 can be pivotally and movably received within the opening 104 of the mounting lug 103.

Referring to FIG. 4A, when the keycap 10 is assembled to the substrate 20 by means of the supporting linkages 11, a top end 122 of the actuator 12 abuts against the mounting surface 102 of the keycap 10. In this case, the membrane switch is located at an "open" position. Furthermore, the keycap 10 is properly balanced and supported by the supporting linkages 11.

Referring to FIG. 4B, when an external force is applied to the depressing surface 101 of the keycap 10, the keycap 10 together with the actuator 12 will move downward. As a result, the membrane switch disposed thereunder will be located at a "closed" position.

Sometimes the external force is not centrally applied onto the depressing surface 101 of the keycap 10 whereby the actuation of the actuator 12 will be insufficiently rendered and the membrane switch may not be actuated even when the keycap 10 has been depressed. in order to ensure an effective actuation of the actuator 12, the keycap 10 can be uniformly depressed even if the external force is applied to a corner thereof, thereby generating a corresponding signal as the membrane is effectuated. Accordingly, each vertical portion 111 of the supporting linkages 11 is provided with an extension 114 forming a teeth port 116 at a free end 115 thereof When the supporting linkages 11 are assembled, the teeth 116 of the supporting linkages 11 mesh with each other. By this arrangement, if an external force is applied onto the corner of the keycap 10, the keycap 10 will still conduct a uniform and smooth downward stroke. In an alternative, the teeth 116 can be replaced with a cam or curve portion having a frictional surface.

As shown in FIGS. 4A and 4B, the extension 114 extends into the opening 21 of the substrate 20. This is advantageous since the dimension of the keyswitch will not be increased. When the keycap 10 is depressed, the supporting linkages 11 are completely received within the keycap 10 so that the overall height of the keyswitch assembly is equal to the height of the keycap 10.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

Therefore, persons of ordinary skill in this field are to understand that all such equivalent structures are to be included within the scope of the following claims.

I claim:

1. A keyswitch assembly, comprising a substrate having an opening defined therein, said substrate further forming a plurality of supporting lugs adjacent to said opening;

a keycap defining a depressing surface and a mounting surface opposite to said depressing surface, and a centerline dividing said depressing surface into first and second side, said mounting surface forming a plurality of mounting lugs thereof; and a supporting linkage set being arranged between said substrate and said keycap, each said supporting linkage including a first end pivotally supported by the corresponding supporting lug of said substrate and a second end movably and pivotally supported by the corresponding mounting lug of said keycap, each said supporting linkage further including an extension having a mating portion at a free end thereof, said mating portion being shaped and designed whereby said mating portions mesh with each other, wherein both mating portions of said supporting linkages extend into said opening of said substrate to reduce the overall height of said assembly.

2. A keyswitch assembly as recited in claim 1, wherein each said supporting linkage has a U-shaped configuration forming a horizontal portion and a vertical portion extending from each lateral end thereof.

3. A keyswitch assembly as recited in claim 1, wherein said first end of each said supporting linkage is a first pivoting bud, and said second end of each said supporting linkage is a second pivoting bud.

4. A keyswitch assembly as recited in claim 1, wherein said extension of each of said supporting linkage extends from each said vertical portion thereof.

5. A keyswitch assembly as recited in claim 1, wherein said first and second ends are arranged at a first side defined by said centerline.

6. A key switch assembly including:

a substrate having an opening defined therein, said substrate further forming a plurality of supporting lugs adjacent to said opening;

a keycap defining a depressing surface and a mounting surface opposite to said depressing surface, said mounting surface forming a plurality of mounting lugs thereof; and supporting linkage set being arranged between said substrate and said keycap, a first pivoting bud of said supporting linkage being pivotally supported by the corresponding supporting lug of the substrate and a second pivoting bus of said supporting linkage being pivotally supported by the corresponding mounting lug of the keycap, a mating portion extending from the first pivoting bud toward a center portion of the keyswitch assembly opposite to the second pivoting bud wherein said mating portion is located within/below the opening of the substrate when the keycap is not depressed while is raised from the opening of the substrate when keycap is depressed.

* * * * *